US012553300B2

(12) United States Patent
Mueller

(10) Patent No.: US 12,553,300 B2
(45) Date of Patent: Feb. 17, 2026

(54) INDEXING TRACK AND PIN

(71) Applicant: Schlumberger Technology Corporation, Sugar Land, TX (US)

(72) Inventor: Andrew Mueller, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 220 days.

(21) Appl. No.: 17/785,097

(22) PCT Filed: Dec. 15, 2020

(86) PCT No.: PCT/US2020/065086
§ 371 (c)(1),
(2) Date: Jun. 14, 2022

(87) PCT Pub. No.: WO2021/126830
PCT Pub. Date: Jun. 24, 2021

(65) Prior Publication Data

US 2023/0003091 A1 Jan. 5, 2023

Related U.S. Application Data

(60) Provisional application No. 62/949,490, filed on Dec. 18, 2019.

(51) Int. Cl.
*E21B 23/00* (2006.01)
*E21B 34/10* (2006.01)

(52) U.S. Cl.
CPC ..... *E21B 23/006* (2013.01); *E21B 34/10* (2013.01); *E21B 23/004* (2013.01)

(58) Field of Classification Search
CPC ..... E21B 23/006; E21B 34/10; E21B 23/004
See application file for complete search history.

(56) References Cited

U.S. PATENT DOCUMENTS 4,650,001 A * 3/1987 Ringgenberg ..... E21B 49/001 166/321
5,195,586 A * 3/1993 Gambertoglio ..... E21B 17/06 166/242.6
6,352,119 B1 * 3/2002 Patel ..... E21B 23/06 166/334.4
8,863,843 B2 10/2014 Wu et al.
8,936,099 B2 1/2015 Hu
(Continued)

FOREIGN PATENT DOCUMENTS

WO 2020227025 A1 11/2020

OTHER PUBLICATIONS

International Preliminary Report on Patentability issued in International Patent application PCT/US2020/065086 dated Jun. 30, 2022, 7 pages.

(Continued)

*Primary Examiner* — Neel Girish Patel
(74) *Attorney, Agent, or Firm* — Jeffrey D. Frantz

(57) ABSTRACT

A downhole tool is hydraulically actuated. The actuation system includes an indexing track and pin assembly. An operator may lose track of the location of the track and pin assembly. The indexing track and pin assembly includes a shifting indexing path. By moving the indexing track and pin assembly through the shifting indexing path, the indexing track and pin assembly will move to a known position without needing any pressure measurement.

12 Claims, 9 Drawing Sheets

(56) References Cited

U.S. PATENT DOCUMENTS

| | | | | |
|---|---|---|---|---|
| 9,068,417 | B2 | 6/2015 | Swenson | |
| 9,683,434 | B2 * | 6/2017 | Machocki | E21B 34/10 |
| 10,514,104 | B2 | 12/2019 | Montiel et al. | |
| 2011/0284233 | A1 * | 11/2011 | Wu | E21B 23/006 175/428 |
| 2012/0199363 | A1 * | 8/2012 | Hu | E21B 23/006 175/57 |
| 2012/0199364 | A1 * | 8/2012 | Frosell | E21B 34/10 166/321 |
| 2013/0105172 | A1 * | 5/2013 | Swenson | E21B 23/006 166/370 |
| 2014/0102797 | A1 * | 4/2014 | Mahajan | E21B 7/28 175/57 |
| 2016/0090815 | A1 * | 3/2016 | Kennedy | E21B 23/006 166/374 |
| 2016/0130897 | A1 * | 5/2016 | Machocki | E21B 29/00 166/240 |
| 2016/0245032 | A1 * | 8/2016 | Hekelaar | E21B 23/006 |
| 2017/0059045 | A1 * | 3/2017 | Montiel | F16K 11/07 |
| 2017/0114601 | A1 * | 4/2017 | Montiel | E21B 23/004 |
| 2018/0238131 | A1 * | 8/2018 | Mackenzie | E21B 23/006 |
| 2019/0249504 | A1 * | 8/2019 | Montiel | E21B 23/004 |

OTHER PUBLICATIONS

International Search Report and Written Opinion issued in International Patent application PCT/US2020/065086 on Apr. 21, 2021, 8 pages.

* cited by examiner

INDEXING TRACK AND PIN

CROSS-REFERENCE TO RELATED APPLICATIONS

This application is a National Stage Entry of International Application No. PCT/US2020/065086, filed on Dec. 15, 2020, which claims the benefit of, and priority to, U.S. Patent Application No. 62/949,490 filed on Dec. 18, 2019, which is incorporated herein by this reference in its entirety.

BACKGROUND OF THE DISCLOSURE

During downhole drilling activities, a downhole tool may be selectively actuated. Some downhole tools may be hydraulically actuated. An actuation system may include an indexing track and pin assembly. In some situations, the actuation status of the downhole tool may be determined by pressure and/or flow rate measurements at the surface. In some situations, an operator at the surface may not be able to determine the actuation status based on pressure measurements and may lose track of the actuation status of the downhole tool.

SUMMARY

In some embodiments, a method for actuating a downhole tool includes moving an indexing pin along an indexing track from a first upper index position to a first indexing position. The first upper index position is on a pass-through indexing path. The method includes moving the indexing pin along the indexing track from the first indexing position to a second upper index position. The second upper index position is on the pass-through indexing path. The method includes moving the indexing pin along the indexing track from the second upper index position to a second indexing position. The method includes moving the indexing pin along the indexing track from the second indexing position to a third upper index position. The third upper index position is on the pass-through indexing path.

In some embodiments, a method for actuating a downhole tool includes decreasing a fluid flow from an actuating flow rate to an indexing flow rate. The indexing flow rate is greater than a low flow rate and less than the actuation flow rate. The method includes increasing the fluid flow from the indexing flow rate to the actuating flow rate. An indexing track and pin assembly is shifted to a known position independent of a starting position of the indexing track and pin assembly.

In some embodiments, an actuation system includes an indexing track and pin assembly. The indexing track and pin assembly includes an indexing track having a plurality of protrusions. At least one of the plurality of protrusions has a non-symmetric shape.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 5-1 through 5-3 are representations of indexing tracks, according to at least one embodiment of the present disclosure;

DETAILED DESCRIPTION

This disclosure relates to devices, systems, and methods for actuating downhole tools. In some embodiments, a downhole tool may be actuated using an indexing track and pin assembly. An increase in hydraulic pressure may cause a piston to move longitudinally. An indexing pin may be inserted into an indexing channel. At an actuation pressure, the indexing pin may follow an indexing path to an actuating position or a pass-through position. By following one of a plurality of indexing paths, the indexing pin may actuate the downhole tool.

In some embodiments, the indexing track may be reset to a known position (e.g., the pre-actuating position or the pre-pass-through position) by following a shifting indexing path. The shifting indexing path may include cycling from a low flow rate to an indexing flow rate and back to the low flow rate. The shifting indexing path may reset the indexing track and pin assembly to the known position without having to determine the position using pressure measurements, either at the surface or downhole. For example, at the low flow rate, the indexing track and pin assembly may be in a pre-actuating position (e.g., a position where, when the flow rate is increased, the indexing track and pin assembly will follow an actuating path to an actuating position in which the downhole tool is actuated). By cycling through the shifting indexing path, the indexing track and pin assembly may change positions to a pre-pass-through position (e.g., a position where, when the flow rate is increased, the indexing track and pin assembly will follow a pass-through path to a pass-through position in which the flow rate is high, but the downhole tool is not actuated).

Cycling through the shifting indexing path starting in the pre-pass-through position may result in the indexing track and pin assembly remaining in the pre-pass-through position. Therefore, regardless of the position of the indexing track and pin assembly, cycling through the shifting indexing path may cause the indexing track and pin assembly to revert to a pre-pass-through position, without the need for pressure or volumetric flow rate measurements at the downhole tool. This may allow the operator to set the indexing track and pin assembly to the pre-pass-through position, which may help to prevent unintended actuation of the downhole tool and ensure that the operator knows in what state the indexing track and pin assembly is positioned.

Figure 1:
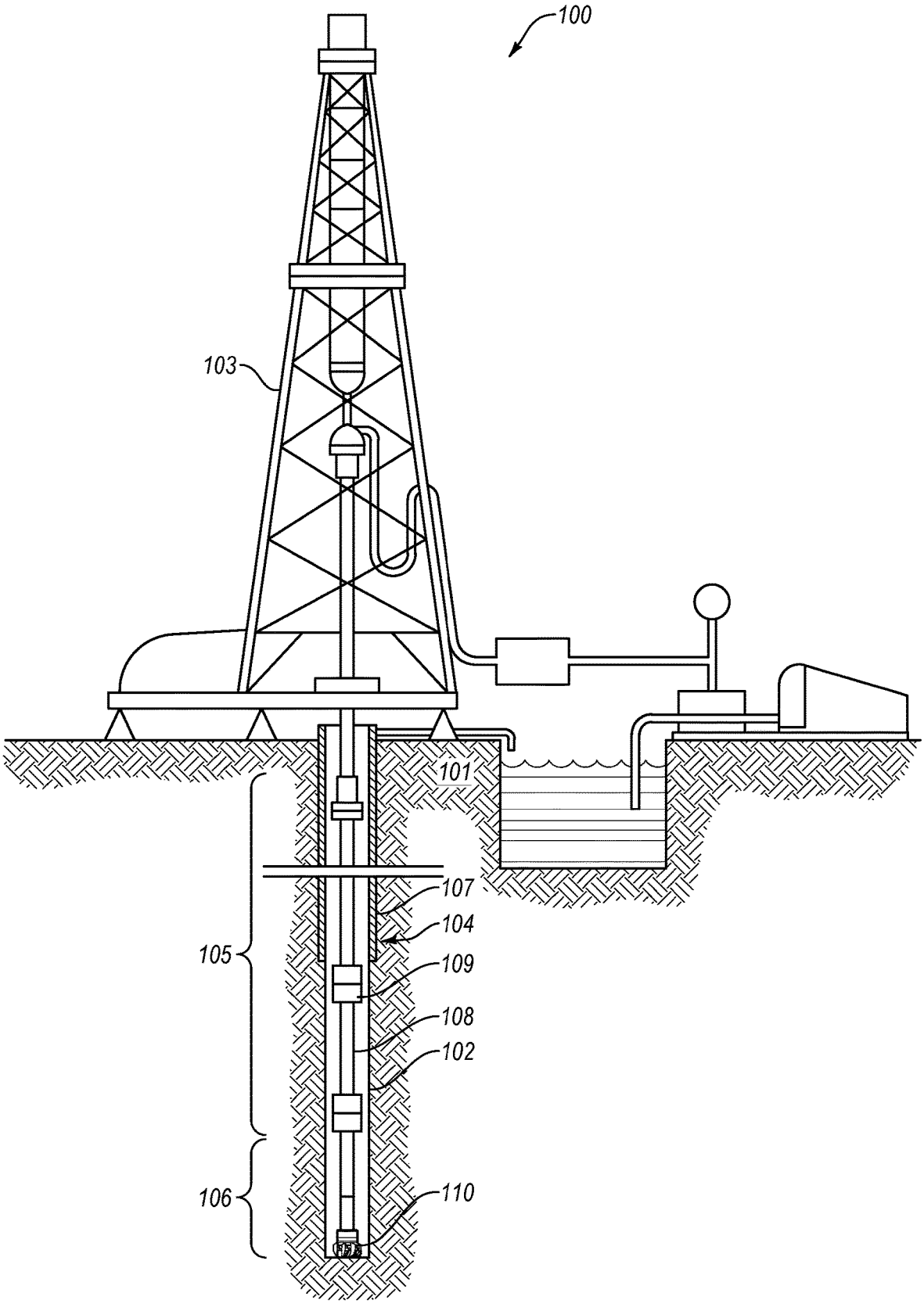
FIG. 1 is a representation of a drilling system, according to at least one embodiment of the present disclosure.

FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing. The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

Figure 2:
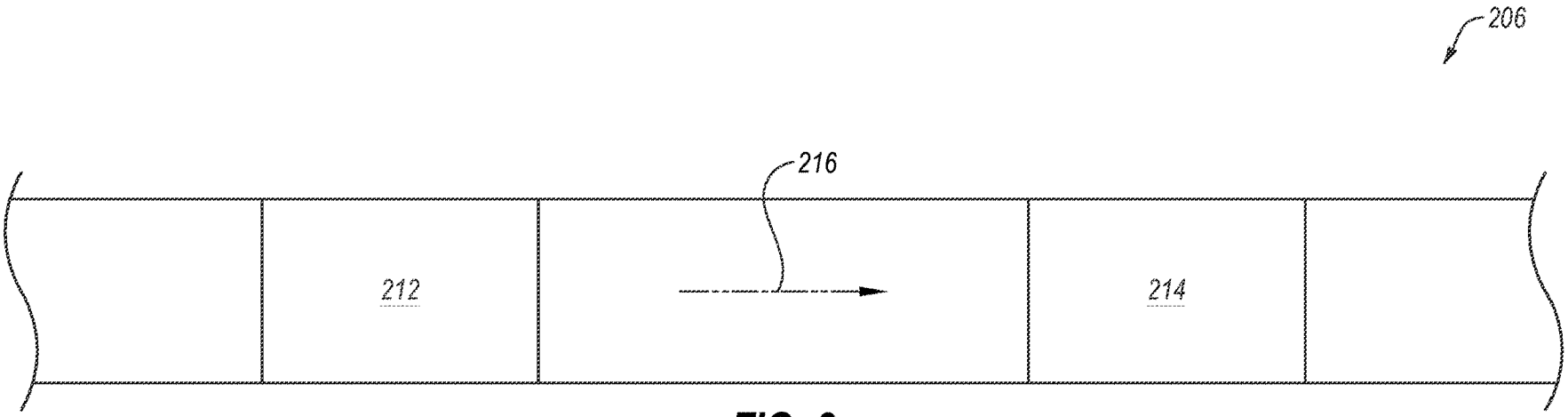
FIG. 2 is a schematic representation of a bottomhole assembly, according to at least one embodiment of the present disclosure.

FIG. 2 is a schematic representation of at least a portion of a BHA 206, according to at least one embodiment of the present disclosure. The BHA 206 shown includes a downhole motor 212 and a downhole tool 214. A fluid flow 216 may flow through the BHA 206. In the embodiment shown, the downhole tool 214 is located downstream of the fluid flow 216 from the downhole motor 212. In other words, the downhole tool 214 is located downhole of the downhole motor 212. For example, the downhole tool 214 may be an expandable tool, such as a reamer, a stabilizer, a directional drilling steering pad, any other expandable tool, and combinations thereof. In some examples, the downhole tool 214 may be any other downhole tool, such as a mud pulse generator, downhole turbine, any other downhole tool, and combinations thereof. While the downhole tool 214 is shown as below the downhole motor 212, it should be understood that the downhole tool 214 may be located in any location on a drilling assembly, including uphole (e.g., upstream) of the downhole motor 212.

In some embodiments, the downhole tool 214 may be hydraulically actuated. Hydraulic actuation of a downhole tool 214 may change the pressure of the fluid flow 216. In some embodiments, the difference in pressure between an actuated and a deactuated hydraulically actuated downhole tool 214 may be measurable at the surface. In other words, an operator at the surface may be able to determine whether the downhole tool 214 is actuated or deactuated based on the pressure of the fluid flow 216. In some embodiments, the operator may not be able to determine whether the downhole tool 214 is actuated or deactuated because the pressure drop is not large enough to be reliably measured at the surface, or because other downhole tools, such as the downhole motor 212, may prevent the pressure drop from reliably and measurably transmitting to the surface. In other words, the operator may not be able to determine whether the downhole tool 214 is actuated based on a pressure measurement of the downhole tool 214 at the surface or at the downhole tool 214.

If the operator cannot determine the actuation status of the downhole tool 214, the operator may erroneously actuate or deactuate the downhole tool 214. This may cause the downhole tool 214 to operate at the wrong time or not to operate when intended. This may cause damage to the wellbore, damage to the downhole tool 214, damage to the BHA 206, reduce penetration rates, throw off the course of the wellbore, cause other challenges, and combinations thereof. An indexing track and pin assembly according to embodiments of the present disclosure may allow the operator to reset the downhole tool 214 to a known position. This may allow the operator to reliably operate the downhole tool, thereby reducing damage to downhole components, increasing the rate of penetration, and reducing costs.

Figure 3:
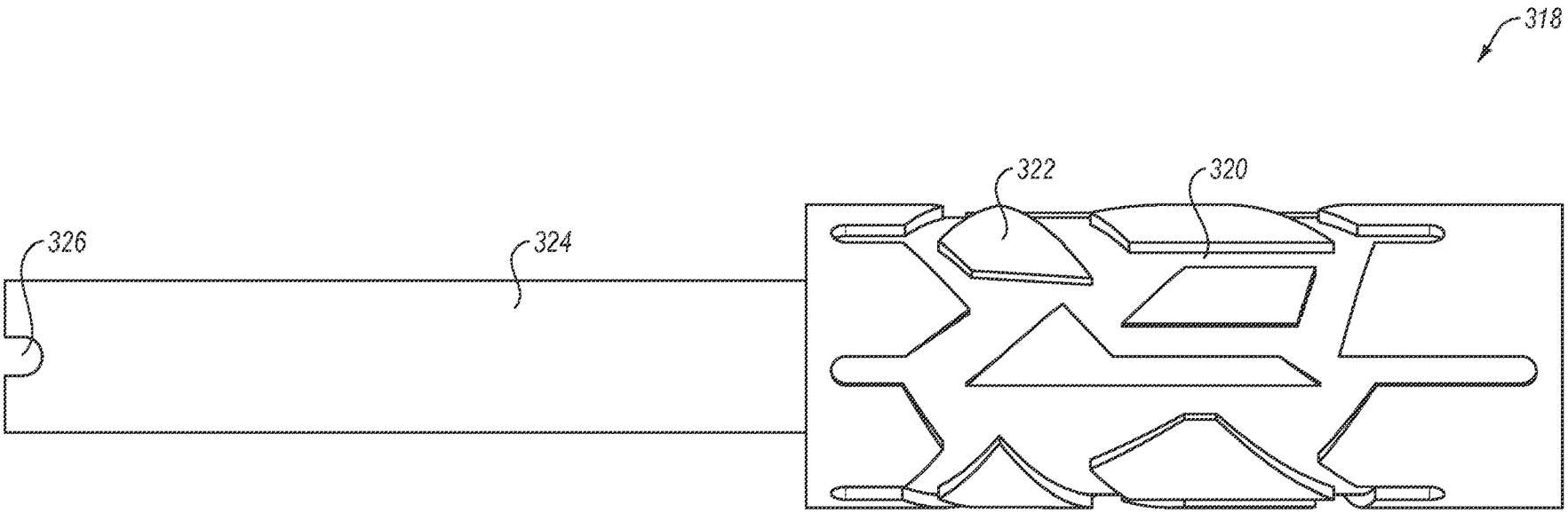
FIG. 3 is a representation of an indexing track and pin assembly, according to at least one embodiment of the present disclosure.

FIG. 3 is a side view of a representation of an indexing track 318 of an indexing track and pin assembly, according to at least one embodiment of the present disclosure. The indexing track 318 includes an indexing channel 320 and a plurality of protrusions 322. As discussed below, An indexing pin may be inserted into the indexing channel 320. Longitudinal movement of the indexing track 318 relative to the indexing pin (e.g., by a hydraulic pressure and/or a resilient member) and may follow one of a plurality of indexing paths. When the indexing pin contacts one of the protrusions 322, at least one of the indexing pin and indexing track 318 may rotate.

The indexing track 318 is connected to a valve shaft 324. The valve shaft 324 includes an opening 326. As the indexing track 318 moves longitudinally and rotates in response to the indexing pin contacting a protrusion 322, the opening may rotationally and longitudinally align with a port in a surrounding piston, which may allow fluid to flow through the opening, into the port, and actuate the downhole tool (e.g., the downhole tool 214 of FIG. 2).

Figure 4:
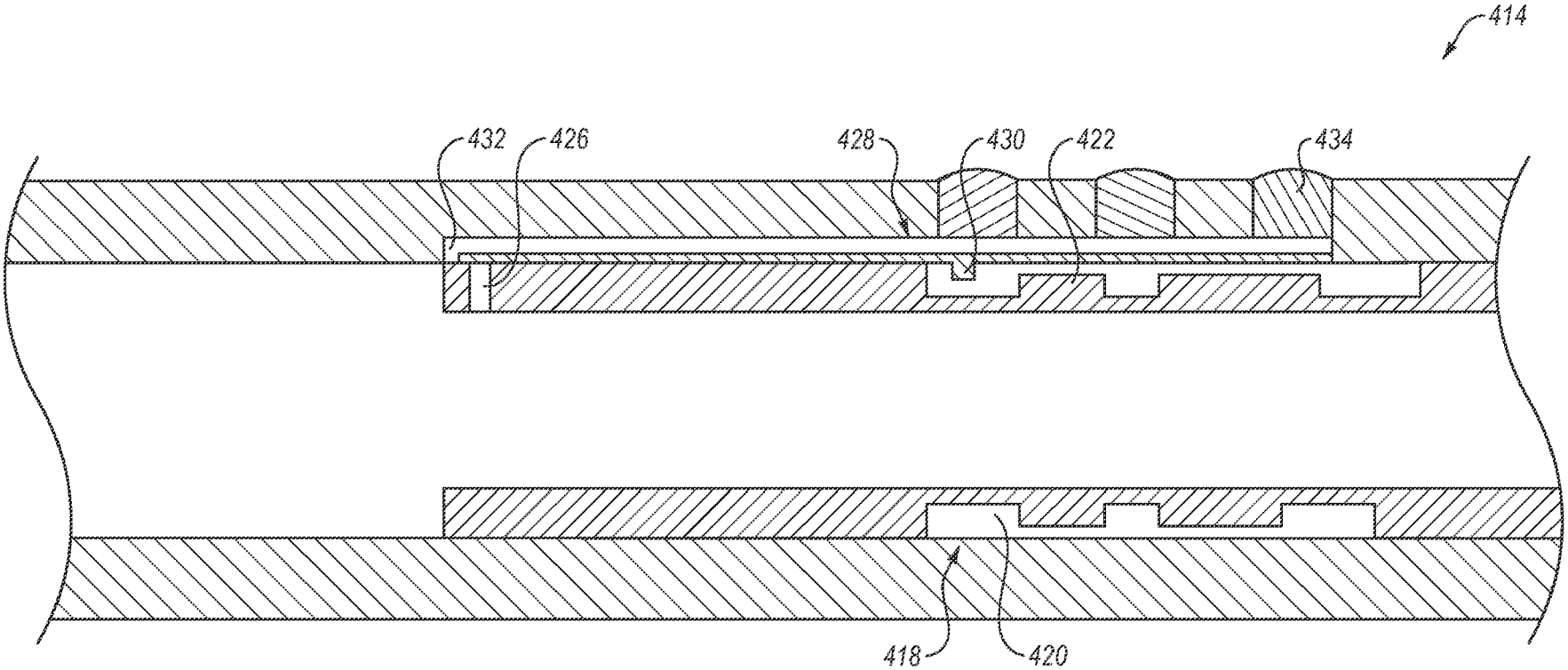
FIG. 4 is a representation of a cross-sectional view of a downhole tool, according to at least one embodiment of the present disclosure.

FIG. 4 is a cross-sectional view of a downhole tool 414, including an indexing track and pin assembly 428, according to at least one embodiment of the present disclosure. The indexing track and pin assembly 428 includes an indexing track 418 and an indexing pin 430. The indexing pin 430 is inserted into an indexing channel 420 of the indexing track 418. As the indexing track 418 moves longitudinally relative to the indexing pin 430, the indexing pin may contact one or more protrusions 422 of the indexing track 418.

Depending on the rotational position of the indexing track 418 (as rotated by the indexing pin 430), fluid flow may enter an actuation channel 432. For example, the fluid may pass through the opening 426 of the indexing track 418. The fluid flow may then actuate the downhole tool 414. In the embodiment shown, a plurality of steering pads 434 may be actuated. The steering pads 434 may be used to point a drill bit during directional drilling. In the embodiment shown, the steering pads 434 may remain actuated during drilling. For example, the steering pads 434 may remain actuated during slide drilling. In some embodiments, a ramp, shim, or other element could directly actuate an expandable tool. For example, the steering pads 434 may be actuated by a ramp on the indexing track, and may not be hydraulically actuated directly.

Figures 1, 5:
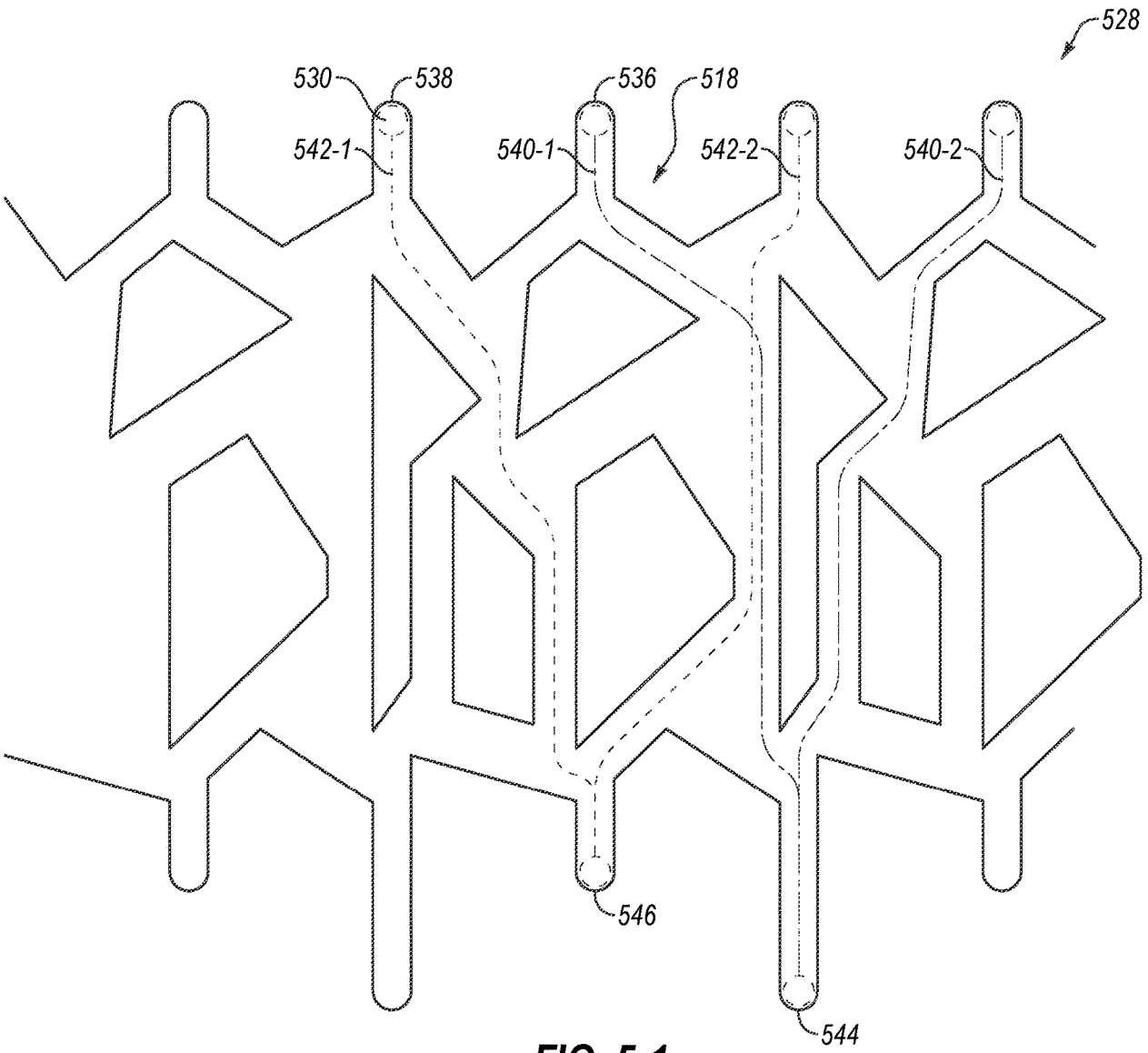
Figures 2, 5:
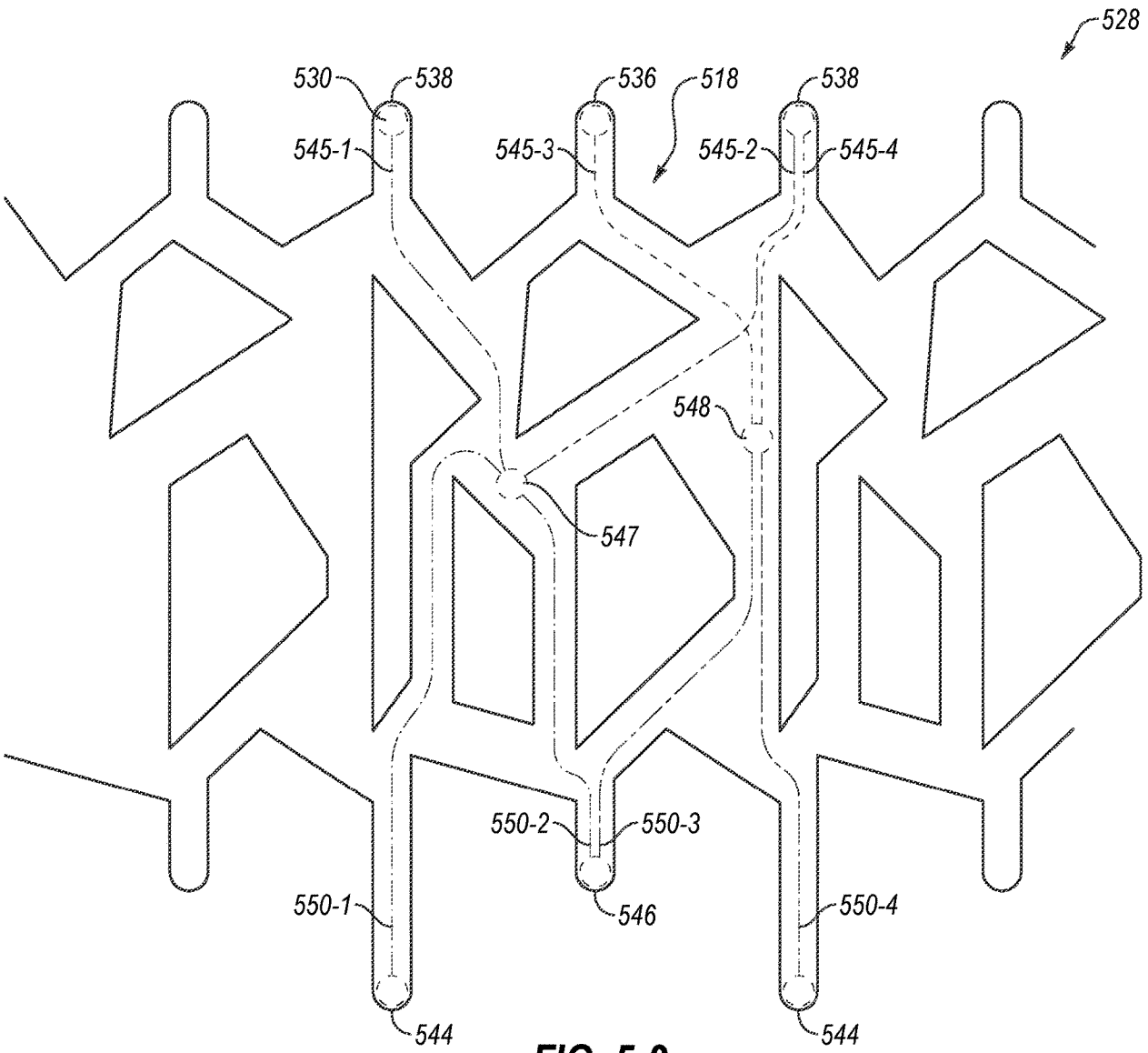
Figures 3, 5:
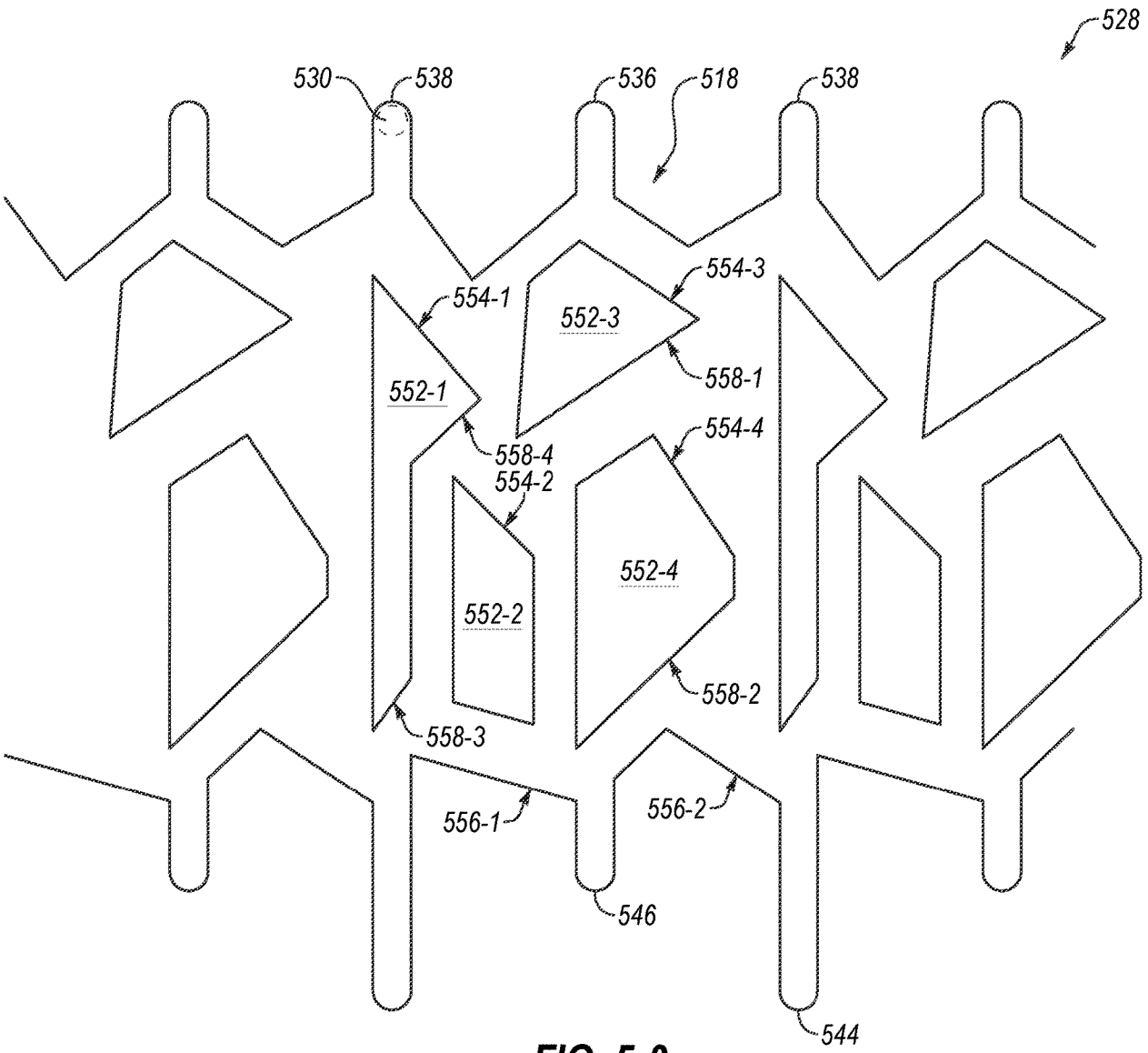

FIG. 5-1 is a representation of an indexing track and pin assembly 528 laid flat (e.g., the circumferential wall of a cylindrical indexing track 518 projected flat), according to at least one embodiment of the present disclosure. When deactuated (e.g., at low flow rates), the indexing pin 530 may be in a pre-actuating position 536 or a pre-pass-through position 538. In the pre-actuating position 536, the indexing track and pin assembly may follow an actuating indexing path (e.g., actuation path 540-1 and the return path 540-2 shown in FIG. 5-1) to an actuating position 544 when the fluid flow is increased to the actuation flow rate. In the pre-pass-through position 538, the indexing track and pin assembly may follow a pass-through indexing path (e.g., pass-through path 542-1 and return path 542-2 shown in FIG. 5-1) to a pass-through position 546 when the fluid flow is increased to the actuation flow rate. As actuating indexing path 540-1, 540-2 and the pass-through indexing path 542-1, 542-2 indicate, multiple cycles of low flow rate to high flow rate may cause the indexing pin 530 to stay on same indexing path. In this manner, the downhole tool may actuate each time the flow rate is increased or move into pass-through mode each time the flow rate is increased.

In some embodiments, the low flow rate may be zero gallons per minute (GPM). In some embodiments, the low flow rate may be less than 50 GPM. In some embodiments, the low flow rate may be greater than 50 GPM. In some embodiments, the high flow rate may be approximately 200 GPM. In some embodiments, the high flow rate may be greater than or less than 200 GPM. In some embodiments, the indexing flow rate may be between the low flow rate and the high flow rate. In some embodiments, the indexing flow rate may be in a range, such as 20%-80% of the high flow rate, 25%-75% of the high flow rate, 30%-70% of the high flow rate, 40%-60% of the high flow rate, 50% of the high flow rate, or any range therebetween.

FIG. 5-2 is a representation of the indexing track and pin assembly 528 of FIG. 5-1 showing the shifting indexing path. In some embodiments, the indexing track 518 may be reset to a known position (e.g., the pre-actuating position 536 or the pre-pass-through position 538) by undergoing a track shift. A track shift may include cycling from the low flow rate to the indexing flow rate and back to the deactuated flow rate or cycling from the actuating flow rate to the indexing flow rate and back to the actuating flow rate. A shifting indexing path (collectively 545) may reset the indexing track and pin assembly 528 to the known position without having to determine the position using pressure measurements, either at the surface or downhole. For example, at the low flow rate, the indexing pin 530 may be in the pre-actuating position 536. By cycling through the shifting indexing path 545, the indexing pin 530 may change positions to the pre-pass-through position 538. Cycling through the shifting indexing path 545 starting in the pre-pass-through position 538 may result in the indexing track and pin assembly remaining in the pre-pass-through position 538. Therefore, regardless of the position of the indexing track and pin assembly 528, cycling through the shifting indexing path 545 may cause the indexing track and pin assembly 528 to revert to a pre-pass-through position 538. It should be understood that, in some embodiments, the shifting indexing path 545 may similarly cause the indexing track and pin assembly 528 to revert to the actuating position 536.

The shifting indexing path 545 may include a first shifting indexing path 545-1, which travels from the pre-pass-through position 538 to a first indexing position 547. The first indexing position 547 may be anywhere within the indexing track 518 that may allow the indexing pin 530 to move back to the pre-pass-through position. A second shifting indexing path 545-2 may travel from the first indexing position 547 back to the pre-pass-through position 538. A third shifting indexing path 545-3 may travel from the pre-actuating position 536 to a second indexing position 548. A fourth shifting indexing path 545-4 may travel from the second indexing position 548 to the pre-pass-through position 538.

Shifting to a known position may allow the operator to know the position of the indexing track and pin assembly, independent of pressure measurements, sensors, or any other indicia of indexing track and pin assembly position. This may reduce the complexity of downhole systems, reduce the possibility for erroneous actuation of a downhole tool, reduce damage to the downhole tool and/or the wellbore, save time, money, provide other benefits, and combinations of the foregoing.

To change the indexing track and pin assembly to the pre-actuating position 536, the indexing track and pin assembly 528 may follow a changing indexing path (collectively 550). The changing indexing path 550 may include changing a flow rate from the high flow rate when the downhole tool is in the actuating position 544 to the indexing flow rate and back to the high flow rate. This may deactuate the downhole tool and cause the indexing track and pin assembly 528 to be moved to the pass-through position 546. The changing indexing path 550 includes a first changing indexing path 550-1 from the actuating position 544 to the first indexing position 547. A second changing indexing path 550-2 may travel from the first indexing position 547 to the pass-through position 546. A third changing indexing path 550-3 may travel from the pass-through position 546 to the second indexing position 548.

And a fourth changing indexing path 550-4 may travel from the second indexing position 548 to the actuating position 544.

In this manner, by utilizing the shifting indexing path 545 and the changing indexing path 550, the operator may be able to shift the indexing pin 530 to a known location (e.g., the pre-pass-through position 538) without having to know the state of the indexing track and pin assembly 528. Then, from the known location, and if desired, the operator may be able to change the indexing pin 530 into the actuating position through the changing indexing path 550. This may provide improve the control of the downhole tool, which may reduce costs and increase rate of penetration.

While the embodiment above has been discussed with the shifting indexing path 545 starting at a low flow rate (e.g., the deactuated flow rate), and the changing indexing path 550 starting at a high flow rate (e.g., the actuating flow rate), it should be understood that the shifting indexing path 545 may start at the high flow rate and the changing indexing path 550 may start at the low flow rate. Furthermore, while the embodiment above has been discussed with the shifting indexing path 545 changing the position of the indexing pin 530 to the pre-pass-through position 538, it should be understood that the shifting indexing path 545 may change the position of the indexing pin 530 to any position (e.g., the pre-actuating position 536, the actuating position 544, the pass-through position 546).

FIG. 5-3 is a representation of the indexing track and pin assembly 528 of FIG. 5-1. In some embodiments, the indexing paths (e.g., the actuating path 540 of FIG. 5-1, the pass-through path 542 of FIG. 5-1, the shifting indexing path 545 of FIG. 5-2, and the changing indexing path of FIG. 5-2) may be directed by a plurality of protrusions (collectively 552) in the indexing track 518. The plurality of protrusions 552 may extend radially outward from the indexing track 518. The walls of the plurality of protrusions 552 may be the walls that the indexing pin 530 contacts while traveling one of the indexing paths.

In some embodiments, one or more protrusions 552 of the plurality of protrusions 552 may be non-symmetrical. A non-symmetrical protrusion 552 may not have any axis of symmetry. In some embodiments, the plurality of protrusions 552 may include a first protrusion 552-1, a second protrusion 552-2, a third protrusion 552-3, and a fourth protrusion 552-4. The indexing pin 530 may move longitudinally from the pre-pass-through position 538 and contact a first upper wall 554-1 on the first protrusion 552-1. The first upper wall 554-1 may direct (e.g., be angled toward) the indexing track and pin assembly 528 to rotate toward the pre-actuating position 536.

When the indexing pin 530 moves and rotates past the first pass-through wall 554-1, the indexing pin 530 may contact a second upper wall 554-2 on the second protrusion 552-2. The second upper wall 554-2 may cause (e.g., be angled toward) the indexing track and pin assembly 528 to further rotate toward the pre-actuating position 536. In some embodiments, as the indexing pin 530 moves and rotates past the second upper wall 554-2, the indexing pin 530 may contact a first transition wall 556-1 between the actuating position 544 and the pass-through position 546. This may rotate and move the indexing track and pin assembly 528 into the pass-through position 546.

In some embodiments, after the indexing pin 530 engages the second upper wall 554-2 and before the indexing pin 530 engages the first transition wall 556-1, the indexing pin 530 may move back toward the pre-actuating position 536 (e.g., the fluid flow may be reduced at the indexing flow). The indexing pin may contact a first lower surface 558-1 on the third protrusion 552-3. The first lower surface 558-1 may cause the indexing track and pin assembly 528 to move circumferentially past the pre-actuating position 536 and toward the pre-pass-through position 538.

In some embodiments, the indexing pin 530 may move toward the third protrusion 552-3 from the pre-actuating position 536. The indexing pin 530 may contact a third upper surface 554-3 on the third protrusion 552-3. The third upper surface 554-3 may cause the indexing track and pin assembly 528 to move and rotate toward the pre-pass-through position 538. After the indexing pin 530 moves past the third upper surface 554-3, the indexing pin may move toward and contact a fourth upper surface 554-4 on the fourth protrusion 552-4. The fourth upper surface 554-4 may further direct the indexing pin 530 to move toward the pre-pass-through position 538. After the indexing pin 530 moves past the fourth upper surface 554-4, the indexing pin 530 may contact a second transition surface 556-2 between the pass-through position 546 and the actuating position 544 and may be directed to the actuating position 544.

In some embodiments, after the indexing pin 530 passes the third upper surface 554-3, the flow may be reduced from an indexing flow to the low flow. This may cause the indexing pin 530 to move back toward the pre-pass-through position 538 and be directed into the pass-through pass position 538. Thus, the shifting path starting from the pre-actuating position 536 may cause the indexing pin 530 to be shifted back to the pre-pass-through position 538.

In some embodiments, to change from the pass-through position 546 to the actuating position 544, the indexing pin 530 may move from the pass-through position 546 and contact a second lower wall 558-2 on the fourth protrusion 552-4, which may cause the indexing track and pin assembly 528 to move and rotate toward the actuating position 544. After the indexing pin 530 has moved from the second lower wall 558-2, the flow rate may be increased from an indexing flow rate to the actuating flow rate. This may cause the indexing pin 530 to move longitudinally toward the actuating position 544, and the indexing pin 530 may contact the second transition wall 556-2 to move the indexing pin 430 into the actuating position 544.

To change from the actuating position 544 to the pass-through position 546, the indexing pin 530 may move out of the actuating position 544 and contact a third lower wall 558-3 of the first protrusion 552-1. The third lower wall 558-3 may direct the indexing track and pin assembly 528 to rotate toward the pass-through position 546. When the indexing pin 530 moves from the third lower wall 558-3, the indexing pin 530 may be moved to a fourth lower wall 558-4 on the first protrusion 552-1, the fourth lower wall 558-4 may further direct the indexing track and pin assembly 528 to rotate toward the pass-through position 546. When the flow rate is increased from the indexing flow rate to the actuating flow rate, the indexing pin 530 may contact the second upper wall 554-2 on the second protrusion 552-2, which may direct the indexing pin 530 to the pass-through position 546.

Figure 6:
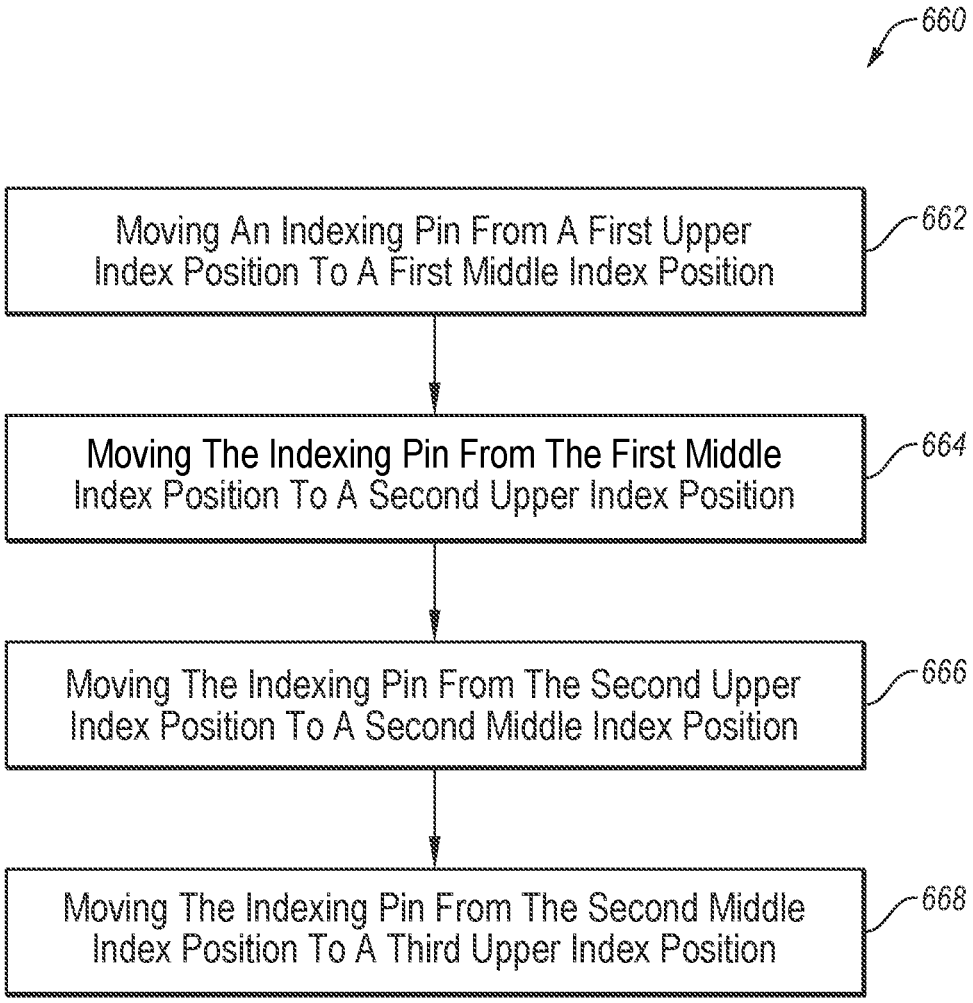
FIG. 6 is a representation of a method for actuating a downhole tool, according to at least one embodiment of the present disclosure.

FIG. 6 is a representation of a method 660 for actuating a downhole tool, according to at least one embodiment of the present disclosure. In some embodiments, the method 660 includes moving an indexing pin from a first upper index position to a first indexing position at 662. The first upper index position may be any upper index position, such as a pre-actuating position or a pre-pass-through position. The method 660 may include moving the indexing pin from the first indexing position to a second upper index position at 664. The second upper index position may be any upper index position, such as a pre-actuating position or a pre-pass-through position. The method 660 may include moving the indexing pin from the second upper index position to a second indexing position at 666 and moving the indexing pin from the second indexing position to a third upper index position at 668. The third upper index position may be the same position as the second upper index position. Or, in other words, the second upper index position and the third upper index position may both be positioned for the indexing pin to follow the same indexing path, such as the actuating indexing path or the pass-through indexing path.

Figure 7:
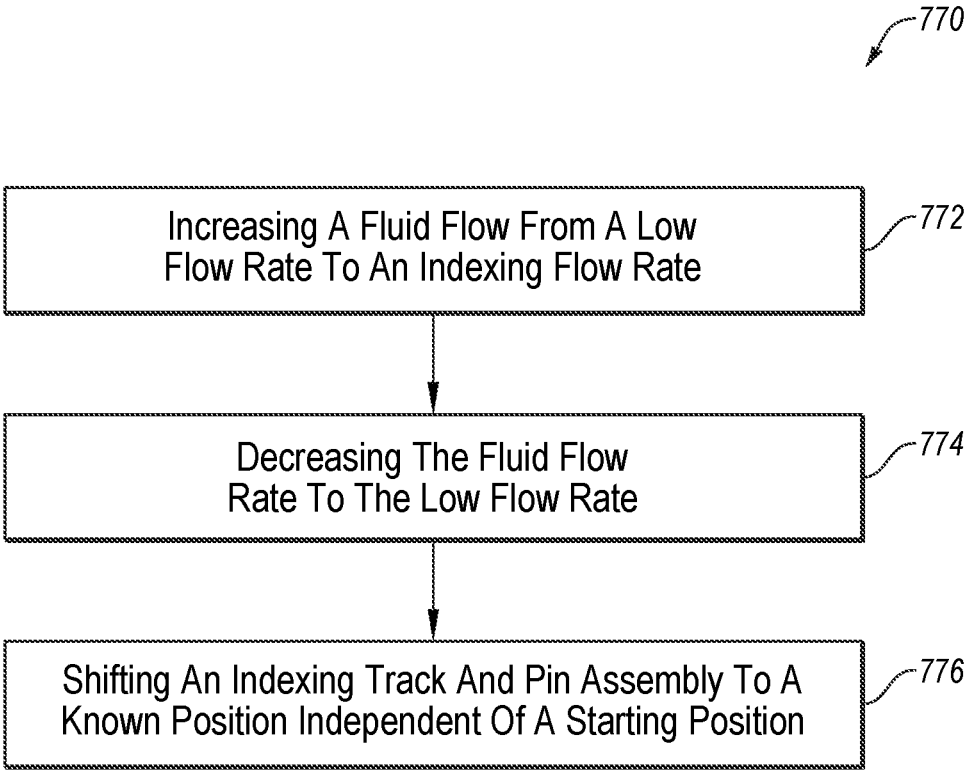
FIG. 7 is another representation of a method for actuating a downhole tool, according to at least one embodiment of the present disclosure.

FIG. 7 is a representation of a method 770 for actuating a downhole tool, according to at least one embodiment of the present disclosure. The method 770 may include increasing a fluid flow from a low flow rate to an indexing flow rate at 772. The method 770 may further include decreasing the fluid flow rate from the indexing flow rate to the low flow rate at 774. The method 770 may include shifting an indexing track and pin assembly to a known position independent of a starting position of the indexing track and pin assembly at 776. In some embodiments, shifting the indexing track and pin assembly may be based on the increase in fluid flow rate to the indexing flow rate and the decrease from the indexing flow rate. In some embodiments, the indexing track and pin assembly may be shifted to the known position without any pressure or volumetric flow rate measurements at the downhole tool.

INDUSTRIAL APPLICABILITY

This disclosure relates to devices, systems, and methods for actuating downhole tools. In some embodiments, a downhole tool may be actuated using an indexing track and pin assembly. An increase in hydraulic pressure may cause a piston to move longitudinally. An indexing pin may be inserted into an indexing channel. At an actuation pressure, the indexing pin may follow an indexing path to an actuating position or a pass-through position. By following one of a plurality of indexing paths, the indexing pin may actuate the downhole tool.

In some embodiments, the downhole tool may be deactuated at a low flow rate. As the flow rate increases to an actuating flow rate, the indexing pin may follow an actuating indexing path in the indexing track, which may cause the indexing track and pin assembly to move to an actuating position. In the actuating position, the downhole tool may be actuated. As the flow rate decreases from the actuating flow rate (e.g., the high flow rate) to the low flow rate, the indexing track and pin assembly may move to a pass-through position. In some embodiments, the indexing track and pin assembly may be cylindrical, and therefore the cycle of deactuated to actuated may be repeated indefinitely by cycling the flow rate between the deactuated flow rate and the actuating flow rate.

In some embodiments, when the flow rate increases from the deactuated flow rate to the actuating flow rate, the indexing pin may follow a pass-through indexing path in the indexing channel. The pass-through indexing path may cause the indexing pin to move to a pass-through position. In the pass-through position, the downhole tool is deactuated while the fluid flow is at or higher than the high flow rate. In this manner, the downhole tool may be included on a BHA for use during downhole operations. In some embodiments, the indexing track and pin assembly may be cylindrical, and therefore the cycle of deactuated to pass-through may be repeated indefinitely.

In some embodiments, the indexing track and pin assembly may change the indexing path from the actuating indexing path to the pass-through indexing path. In other words, the cycle of deactuated to actuated may be changed to the cycle of deactuated to pass-through. By changing the indexing path, the downhole tool may be selectively actuated when needed or desired. In some embodiments, changing the indexing path may be accomplished by changing the fluid flow from the high flow rate to an indexing flow rate, the indexing flow rate having a flow rate between the low flow rate and the high flow rate. The flow rate may then be increased from the indexing flow rate to the high flow rate. In this manner, the indexing path may be changed. In some embodiments, the indexing path may be changed by changing the indexing flow rate from the low flow rate to the indexing flow rate and back to the low flow rate.

In some embodiments, when the flow rate is increased to the high flow rate, the difference in pressure drop between the actuating position and the pass-through position may be different. In some embodiments, this difference in pressure drop may be detected by the operator at the surface. In this manner, the operator may be able to determine whether the downhole tool is actuated based on the measured pressure drop.

In some embodiments, the pressure drop may not be detectable, or may be unreliably detectable, at the surface. For example, the downhole tool may be located downhole of a mud motor. The mud motor may mask or reduce the effects of pressure drops of any downhole tool downhole of the mud motor. In some embodiments, the pressure drop may be too low to be measured. In this situation, to determine whether the downhole tool is actuated, the operator may need to keep track of whether the indexing paths have been changed by cycling through the indexing flow. However, it is possible for the operator to lose track of the indexing path. For example, the operator may not pay attention, may forget to write down the initial indexing path, or may lose track of the indexing path through any other operator error. In some embodiments, even if the operator is careful and has not made any errors, the indexing path may change by accident, such as by a momentary loss or reduction in circulation not detected at the surface. Not knowing on which indexing path the indexing track and pin assembly is located may cause the downhole tool to unintentionally actuate and/or not to actuate when desired. This may damage the wellbore, damage the downhole tool, reduce the rate of penetration, increase costs, cause any other concern, and combinations thereof.

When deactuated (e.g., at low flow rates), the indexing track and pin assembly may be in a pre-actuating position or a pre-pass-through position. In the pre-actuating position, the indexing track and pin assembly may follow the actuating indexing path when the fluid flow is increased to the actuation flow rate. In the pre-pass-through position, the indexing track and pin assembly may follow the pass-through indexing path when the fluid flow is increased to the actuation flow rate.

In some embodiments, the indexing track may be reset to a known position (e.g., the pre-actuating position or the pass-through position) by undergoing a track shift. A track shift may include cycling from the low flow to the indexing flow and back to the low flow. The shifting indexing path may reset the indexing track and pin assembly to the known position without having to determine the position using pressure measurements, either at the surface or downhole. For example, at the low flow rate, the indexing track and pin assembly may be in the pre-actuating position. By cycling through the shifting indexing path, the indexing track and pin assembly may change positions to the pre-pass-through position. Cycling through the shifting indexing path starting in the pre-pass-through position may result in the indexing track and pin assembly remaining in the pre-pre-pass-through position. Therefore, regardless of the position of the indexing track and pin assembly, cycling through the shifting indexing path may cause the indexing track and pin assembly to revert to the pre-pass-through position. It should be understood that the shifting indexing path may similarly cause the indexing track and pin assembly to revert to the pre-actuating position.

Shifting to a known position may allow the operator to know the position of the indexing track and pin assembly, independent of pressure measurements, sensors, or any other indicia of indexing track and pin assembly position. This may reduce the complexity of downhole systems, reduce the possibility for erroneous actuation of a downhole tool, reduce damage to the downhole tool and/or the wellbore, save time, money, provide other benefits, and combinations of the foregoing.

To change the indexing track and pin assembly to the pre-actuating position, the indexing track and pin assembly may follow a changing indexing path. The changing indexing path may include changing a flow rate from the high flow rate when the downhole tool is in the pass-through position to the indexing flow rate and back to the high flow rate. This may actuate the downhole tool and change the indexing track and pin assembly to follow the actuating path. While the embodiment above has been discussed with the shifting indexing path starting at a low flow rate (e.g., the deactuated flow rate), and the changing indexing path starting at a high flow rate (e.g., the actuating flow rate), it should be understood that the shifting indexing path may start at the high flow rate and the changing indexing path may start at the low flow rate.

In some embodiments, the indexing track and pin assembly includes an indexing pin inserted into an indexing track. To follow the actuating indexing path, the indexing pin is inserted into the indexing track in a first pre-actuating position (e.g., a first upper position). The indexing track and/or the indexing pin may move longitudinally relative to each other in a first direction. As the indexing pin contacts a wall of the indexing track, one or both of the indexing track and the indexing pin may rotate relative to each other. The combined rotational and longitudinal movement may cause the indexing pin to move into the actuating position to actuate the downhole tool (e.g., a first lower index position).

The actuating indexing path may include moving the indexing track and/or the indexing pin longitudinally in a second direction opposite the first direction. The indexing pin may contact a wall of the indexing track, which may cause one or both of the indexing pin and the indexing track to rotate. The indexing pin may move back (e.g., be urged by a resilient member or a piston) into a second pre-actuating position. The indexing track may be cylindrical. Thus, in some embodiments, the first pre-actuating position is the same as the second pre-actuating position. In some embodiments, the first actuating path is different from the second pre-actuating position. By cycling through the actuating indexing path, the indexing pin may move back to the first pre-actuating position and/or the second pre-actuating position. In some embodiments, the indexing track may include 1, 2, 3, 4, 5, 6, 7, 8, 9, 10, or more pre-actuating positions.

To follow the pass-through indexing path, the indexing pin may be inserted into the indexing track at a first pre-pass-through position (e.g., a second upper position). In some embodiments, the indexing track and/or the indexing pin may move longitudinally relative to each other in the first direction. As the indexing pin contacts a wall of the indexing track, one or both of the indexing track and the indexing pin may rotate relative to each other. The combined rotational and longitudinal movement may cause the indexing pin to move into the pass-through position (e.g., a second lower index position).

The pass-through indexing path may include moving the indexing track and/or the indexing pin longitudinally in the second direction. The indexing pin may contact a wall of the indexing track, which may cause one or both of the indexing pin and the indexing track to rotate. The indexing pin may move back (e.g., be urged by a resilient member or a piston) into a second pre-pass-through position. The indexing track may be cylindrical. Thus, in some embodiments, the first pre-pass-through position is the same as the second pre-pass-through position. In some embodiments, the first pass-through path is different from the second pre-pass-through position. By cycling through the pass-through indexing path, the indexing pin may move back to the first pre-pass-through position and/or the second pre-pass-through position. In some embodiments, the indexing track may include 1, 2, 3, 4, 5, 6, 7, 8, 9, 10, or more pre-pass-through positions.

Moving the indexing pin along the shifting indexing path may include moving the indexing pin longitudinally in the first direction. The indexing pin may contact a wall of the indexing track, which may direct one or both of the indexing pin and the indexing track to rotate. The indexing pin may move from the pre-actuating position into a first indexing position located longitudinally between the pre-actuating position and the actuating position (and between the pre-pass-through position and the pass-through position). The indexing pin may then move longitudinally in the second direction (with the corresponding rotational movement) to the pre-pass-through position. Similarly, the indexing pin may start in the first pre-pass-through position, move to a second indexing position, and back to the second pre-pass-through position. Thus, regardless of the starting position of the indexing pin, the shifting indexing path may move the indexing pin to a pre-actuating position.

Moving the indexing pin along the changing indexing path may include moving the indexing pin longitudinally in the second direction. The indexing pin may contact a wall of the indexing track, which may cause one or both of the indexing pin and the indexing track to rotate. The indexing pin may move from the pass-through position into a first changing position located longitudinally between the pre-actuating position and the actuating position (and between the pre-pass-through position and the pass-through position). The indexing pin may then move longitudinally in the first direction (with the corresponding rotational movement) to the actuating position. Similarly, the indexing pin may start in the actuating position, move to a second changing position, and back to the pass-through position. Thus, the indexing path may be changed between the actuating path and the pass-through path.

In some embodiments, the indexing paths (e.g., the actuating indexing path, the pass-through indexing path, the shifting indexing path, and the changing indexing path) may be directed by a plurality of protrusions in the indexing track. The plurality of protrusions may extend radially outward from the indexing track. The walls of the plurality of protrusions may be the walls that the indexing pin contacts while traveling one of the indexing paths.

In some embodiments, the plurality of protrusions may be non-symmetrical. A non-symmetrical protrusion may not have any axis of symmetry. In some embodiments, the plurality of protrusions may include a first protrusion, a second protrusion, a third protrusion, and a fourth protrusion. The indexing pin may move longitudinally from the pre-pass-through position and contact a first upper wall on the first protrusion. The first upper wall may direct (e.g., be angled toward) the indexing pin and/or the indexing path to rotate toward the pre-actuating position.

The second protrusion may include a second upper wall. When the indexing pin moves and rotates past the first upper wall, the indexing pin may contact the second upper wall on the second protrusion. The second upper wall may cause (e.g., be angled toward) the indexing pin and/or the indexing track to further rotate toward the pre-actuating position. In some embodiments, as the indexing pin moves and rotates past the second upper wall, the indexing pin may move contact a transition wall between the actuating position and the pass-through position. This may rotate and move the indexing pin into the pass-through position.

In some embodiments, after the indexing pin engages the second upper wall and before the indexing pin engages the transition wall, the indexing pin may move back toward the actuating path position (e.g., the fluid flow may be reduced at the indexing flow). The indexing pin may contact a first lower surface on the third protrusion. The first lower surface may cause the indexing pin and/or the indexing track to move circumferentially past the actuating position and toward the pass-through position.

In some embodiments, the indexing pin may move toward the third protrusion from the pre-actuating position. The indexing pin may contact a third upper wall on the third protrusion. The third upper wall may cause the indexing track and/or the indexing pin to move and rotate toward the pre-pass-through position. After the indexing pin moves past the third upper wall, the indexing pin may move toward and contact a fourth upper wall on the fourth protrusion. The fourth upper wall may further direct the indexing pin to move toward the pre-pass-through position. After the indexing pin moves past the fourth upper wall, the indexing pin may contact a second transition surface between the pass-through position and the actuating position and may be directed to the actuating position.

In some embodiments, after the indexing pin passes the third upper wall, the flow may be reduced from the indexing flow rate to the low flow rate. This may cause the indexing pin to move back toward the pre-pass-through position and be directed into the pass-through pass position. Thus, the shifting indexing path starting from the pre-actuating position may cause the indexing pin to be shifted back to the pre-pass-through position.

In some embodiments, to change from the pass-through position to the actuating position, the indexing pin may move from the pass-through position and contact a first lower wall on the fourth protrusion, which may cause (e.g., be angled toward) the indexing pin and/or the indexing track to move rotate toward the actuating position. After the indexing pin has moved from the first lower wall, the flow may be increased from an indexing flow to the actuating flow. This may cause the indexing pin to move longitudinally toward the actuating position, and the indexing pin may contact the second transition wall to move the indexing pin into the actuating position.

To change from the actuating position to the pass-through position, the indexing pin may move out of the actuating position and contact a second lower wall of the first protrusion. The second lower wall may direct (e.g., be angled toward) the indexing pin and/or the indexing track to rotate toward the pass-through position. When the indexing pin moves from the second lower wall, the indexing pin may be moved to a third lower wall on the first protrusion, the third lower wall may further direct the indexing pin and/or the track to rotate toward the pass-through position. When the flow is increased from the indexing flow to the actuating flow, the indexing pin may contact the second upper surface on the second protrusion, which may direct the indexing pin to the pass-through position.

In some embodiments, a method for actuating a downhole tool includes moving an indexing pin from a first upper index position to a first indexing position. The first upper index position may be any upper index position, such as a pre-actuating position or a pre-pass-through position. The method may include moving the indexing pin from the first indexing position to a second upper index position. The second upper index position may be any upper index position, such as a pre-actuating position or a pre-pass-through position. The method may include moving the indexing pin from the second upper index position to a second indexing position and moving the indexing pin from the second indexing position to a third upper index position. The third upper index position may be the same position as the second upper index position. Or, in other words, the second upper index position and the third upper index position may both be positioned for the indexing pin to follow the same indexing path, such as the actuating indexing path or the pass-through indexing path.

In some embodiments, a method for actuating a downhole tool includes increasing a fluid flow from a low flow rate to an indexing flow rate. The method may further include decreasing the fluid flow rate from the indexing flow rate to the low flow rate. The method may include shifting an indexing track and pin assembly to a known position independent of a starting position of the indexing track and pin assembly. In some embodiments, shifting the indexing track and pin assembly may be based on the increase in fluid flow rate to the indexing flow rate and the decrease from the indexing flow rate. In some embodiments, the indexing track and pin assembly may be shifted to the known position without any pressure or volumetric flow rate measurements at the downhole tool.

Following are sections of the systems and methods of the present disclosure:

1. A method for actuating a downhole tool, comprising:
   - moving an indexing pin along an indexing track from a first upper index position to a first indexing position, the first upper index position being on a pass-through indexing path;
   - moving the indexing pin along the indexing track from the first indexing position to a second upper index position, the second upper index position being on the pass-through indexing path;
   - moving the indexing pin along the indexing track from the second upper index position to a second indexing position; and
   - moving the indexing pin along the indexing track from the second indexing position to a third upper index position, the third upper index position being on the pass-through indexing path.
2. The method of section 1, comprising:
   - moving the indexing pin along the indexing track from the first upper index position to a first lower index position, the first lower index position corresponding to a pass-through position; and
   - moving the indexing pin along the indexing track from the first lower index position to the third upper index position, the third upper index position being on the pass-through indexing path.

3. The method of section 1 or section 2, comprising:
moving the indexing pin along the indexing track from the first upper index position to a second lower index position, the second lower index position being a pass-through position;
moving the indexing pin along the indexing track from the second lower index position to a third indexing position located longitudinally between the first upper index position and the second lower index position; and
moving the indexing pin along the indexing track from the third indexing position to a third lower index position, the third lower index position being an actuating position.

4. The method of any of sections 1-3, comprising:
moving the indexing pin along the indexing track from the second upper index position to a second lower index position, the second lower index position corresponding to an actuating position; and
moving the indexing pin along the indexing track from the second lower index position to a fourth upper index position, the fourth upper index position being on an actuating path.

5. The method of any of sections 1-4, comprising:
moving the indexing pin along the indexing track from the second upper index position to a second lower index position, the second lower index position being an actuating position;
moving the indexing pin along the indexing track from the second lower index position to a fourth indexing position located longitudinally between the first upper index position and the second lower index position; and moving the indexing pin from the fourth indexing position to a third lower index position, the third lower index position being a pass-through position.

6. The method of any of sections 1-5, comprising:
moving the indexing pin along the indexing track from the second upper index position to a first lower index position; and
actuating a downhole tool when the indexing pin is in the first lower index position.

7 The method of any of sections 1-6, wherein moving an indexing pin along an indexing track from a first upper index position to a first indexing position comprises contacting the indexing pin on a first upper surface on a first protrusion and contacting the indexing pin on a second upper surface on a second protrusion.

8. The method of section 7, wherein moving the indexing pin along the indexing track from the second upper index position to a second indexing position comprises contacting the indexing pin on a third upper surface of a third protrusion.

9. The method of section 8, wherein moving the indexing pin along the indexing track from the second upper index position to a second indexing position comprises contacting the indexing pin on a fourth upper surface of a fourth protrusion.

10. The method of any of sections 1-9, wherein moving the indexing pin along the indexing track from the first indexing position to a second upper index position comprises contacting a lower surface on a protrusion of a plurality of protrusions.

11. A method for actuating a downhole tool, comprising:
decreasing a fluid flow from an actuating flow rate to an indexing flow rate, the indexing flow rate being greater than a low flow rate and less than the actuation flow rate;
increasing the fluid flow from the indexing flow rate to the actuating flow rate; and
shifting an indexing track and pin assembly to a known position independent of a starting position of the indexing track and pin assembly.

12. The method of section 11, wherein shifting the indexing track and pin assembly includes shifting the indexing track and pin assembly to the known position without a pressure measurement of the fluid flow.

13. The method of section 11 or section 12, comprising:
increasing the fluid flow from the low flow rate to the actuation flow rate;
moving the indexing track and pin assembly into an actuating position based on the actuation flow rate; and
actuating the downhole tool when the indexing track and pin assembly are in the actuating position.

14. The method of any of sections 11-13, wherein the known position is on a pass-through position.

15. The method of any of sections 11-14, wherein the known position is an actuating position.

16. An actuation system, comprising:
an indexing track and pin assembly configured to operate a downhole tool based on a position of the indexing track and pin assembly, the indexing track and pin assembly comprising an indexing track comprising a plurality of protrusions, at least one of the plurality of protrusions having a non-symmetric shape.

17. The actuation system of section 16, the plurality of protrusions including a plurality of walls, the plurality of walls being configured to rotate the indexing track and pin assembly based on contact of the wall with an indexing pin.

18. The actuation system of section 16 or section 17, the indexing track comprising a pre-pass-through position and a pre-actuating position, a first upper wall on a first protrusion of the plurality of protrusions being located longitudinally below the pre-pass-through position and a second upper wall on a second protrusion of the plurality of protrusions being located longitudinally below the first upper wall.

19. The actuation system of section 18, the indexing track comprising a third protrusion of the plurality of protrusions, the third protrusion including a first lower wall above the second upper wall, the first lower wall being angled toward the pre-pass-through position.

20. The actuation system of section 18 or section 19, a third protrusion of the plurality of protrusions including a third upper surface, the third upper surface being longitudinally below the pre-actuating position, the third upper surface being angled toward pre-pass-through position.

The embodiments of the actuation system have been primarily described with reference to wellbore drilling operations; the actuation systems described herein may be used in applications other than the drilling of a wellbore. In other embodiments, actuation systems according to the present disclosure may be used outside a wellbore or other downhole environment used for the exploration or production of natural resources. For instance, actuation systems of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method for actuating a downhole tool, the method comprising:

positioning an indexing pin at a starting position in an indexing track by providing a supply pressure of a flow of a downhole fluid to the downhole tool, wherein the indexing track includes a set of starting positions based on the supply pressure, the set of starting positions including:

a first position based on the supply pressure at a first pressure, wherein the first position is an actuating position and positioned at an actuating downhole end of an actuating slot of the indexing track, wherein, in the actuating position, a valve of the downhole tool is open to allow the downhole fluid to flow through an opening in a valve shaft connected to the indexing track, wherein the opening opens into a port in a surrounding piston to actuate a component of the downhole tool;

a second position based on the supply pressure at the first pressure, the second position rotationally offset from the first position, wherein the second position is a passthrough position and is positioned at a passthrough downhole end of a passthrough slot of the indexing track;

a third position based on the supply pressure second pressure, wherein the third position is a pre-actuating position and is positioned at a pre-actuating uphole end of a pre-actuating slot of the indexing track, wherein the first pressure is higher than the second pressure; and a fourth position based on the supply pressure second pressure, the fourth position rotationally offset from the third position, wherein the fourth position is a pre-passthrough position and is positioned at a pre-passthrough uphole end of a pre-passthrough slot of the indexing track;

wherein when the supply pressure is the first pressure, the starting position is the first position or the second position, and when the supply pressure is the second pressure, the starting position is the third position or the fourth position; and performing an indexing sequence, the indexing sequence including:

moving the indexing pin from the starting position to an indexing position of the indexing track by changing the supply pressure from the first pressure or the second pressure to an indexing pressure, wherein the indexing pressure is an intermediate pressure between the first pressure and the second pressure; and after the indexing pin has moved to the indexing position of the indexing track, moving the indexing pin from the indexing position of the indexing track to a fifth position of the indexing track by changing the supply pressure to the downhole tool from the indexing pressure to the second pressure, wherein the fifth position is a reset position at a reset uphole end of a reset slot of the indexing track in which the indexing pin is positioned by performing the indexing sequence based on the indexing pin moving to the fifth position of the indexing track regardless of the starting position of the indexing pin being the first position, the second position, the third position, or the fourth position of the set of starting positions of the indexing track.

2. The method of claim 1, wherein the fourth position is a first pre-passthrough position, and the reset position is a second pre-passthrough position.

3. The method of claim 1, wherein moving the indexing pin from the starting position to the indexing position of the indexing track includes moving the indexing pin from the starting position to a first indexing position of the indexing track or to a second indexing position of the indexing track based on the starting position at which the indexing pin is positioned.

4. The method of claim 3, wherein moving the indexing pin to the first indexing position of the indexing track or to the second indexing position of the indexing track includes moving the indexing pin to the first indexing position of the indexing track when the starting position of the indexing pin is the first position or the fourth position of the indexing track, and moving the indexing pin to the second indexing position of the indexing track when the starting position of the indexing pin is the second position or the third position of the indexing track.

5. The method of claim 1, wherein the indexing pin is movable through the indexing track based on the indexing track rotating in a first radial direction, and wherein the indexing track comprises an indexing pattern that is repeated for a plurality of iterations such that the indexing track is continually rotatably in the first radial direction.

6. The method of claim 5, wherein the second position is located rotationally after the first position in the first radial direction of a rotation of the indexing track.

7. The method of claim 5, wherein the third position is located rotationally after the fourth position in the first radial direction of a rotation of the indexing track.

8. The method of claim 5, wherein the first position, the second position, the third position, and the fourth position are included on a first iteration of the indexing pattern and the reset position is included on a second iteration of the indexing pattern, and wherein the reset position is the same position on the second iteration of the indexing pattern as is the fourth position on the first iteration of the indexing pattern.

9. The method of claim 8, wherein the indexing track is a cylindrical indexing track rotatable to a third iteration, and wherein the third iteration overlaps the first iteration.

10. The method of claim 8, wherein the cylindrical indexing track is indefinitely rotatable through the first iteration and the second iteration.

11. The method of claim 1, further comprising:

moving the indexing pin from the starting position to the indexing position without knowing whether the starting position is the first position, the second position, the third position, or the fourth position of the set of starting positions; and after the indexing pin has moved to the indexing position, moving the indexing pin from the indexing position to the fifth position regardless of the starting position being the first position, the second position, the third position, or the fourth position of the set of starting positions and without knowing whether the starting position was the first position, the second position, the third position, or the fourth position of the set of starting positions.

12. The method of claim 1, wherein the indexing sequence includes only two pressure events, including:

a first pressure event of changing the supply pressure from the first pressure or the second pressure to the indexing pressure being the intermediate pressure; and a second pressure event of changing the supply pressure from the indexing pressure being the intermediate pressure to the second pressure.

* * * * *